US010591234B2

(12) United States Patent
Beasley

(10) Patent No.: US 10,591,234 B2
(45) Date of Patent: Mar. 17, 2020

(54) PISTOL MAGAZINE ADAPTER

(71) Applicant: Joseph Scott Beasley, Summersville, MO (US)

(72) Inventor: Joseph Scott Beasley, Summersville, MO (US)

( * ) Notice: Subject to any disclaimer, the term of this patent is extended or adjusted under 35 U.S.C. 154(b) by 0 days.

(21) Appl. No.: 15/896,408

(22) Filed: Feb. 14, 2018

(65) Prior Publication Data

US 2018/0180371 A1 Jun. 28, 2018

Related U.S. Application Data

(63) Continuation of application No. 15/224,691, filed on Aug. 1, 2016, now Pat. No. 9,927,193.

(60) Provisional application No. 62/202,107, filed on Aug. 6, 2015, provisional application No. 62/233,325, filed on Sep. 26, 2015.

(51) Int. Cl.
*F41A 9/71* (2006.01)

(52) U.S. Cl.
CPC ..... *F41A 9/71* (2013.01)

(58) Field of Classification Search
CPC ..... F41A 9/65; F41A 9/71
USPC ..... 42/49.02
See application file for complete search history.

(56) References Cited

U.S. PATENT DOCUMENTS 3,771,415 A * 11/1973 Into ..... F41A 3/78 89/16
3,776,095 A * 12/1973 Atchisson ..... F41A 11/02 89/128
4,058,922 A * 11/1977 Elbe ..... F41A 9/71 42/16
4,069,608 A * 1/1978 Jurek ..... F41A 9/71 42/49.02
4,098,016 A * 7/1978 Foote ..... F41A 21/10 42/16
4,139,958 A * 2/1979 Foote ..... F41A 9/71 42/49.02

(Continued)

OTHER PUBLICATIONS

@WNGTRIPLECATCH, "WNG Glock AR Magwell," https://www.facebook.com/,WNGTripleCatch?fref=nf, Accessed Jul. 2, 2016.

(Continued)

*Primary Examiner* — Joshua E Freeman
*Assistant Examiner* — Bridget A Cochran
(74) *Attorney, Agent, or Firm* — Bennet K. Langlotz; Langlotz Patent & Trademark Works, LLC

(57) ABSTRACT

Pistol magazine adapters have a body closely received in the magazine well and defining a passage receiving a magazine including a follower, a bolt catch actuator mechanism having a follower contact element pivotally connected to the body at a pivot axis and having a follower contact surface operable to contact the follower and responsive to whether the follower is in an upper position when the magazine is empty of ammunition or a lower position in which the magazine contains ammunition, the bolt catch actuator mechanism including a latch actuator element operable to engage the bolt hold open latch, and the latch actuator element being operably engaged to the follower contact element and responsive to movement of the follower to the upper position to move the bolt hold open latch to a bolt restraint position, such that the bolt is held open after depletion of the last round in the magazine.

16 Claims, 12 Drawing Sheets

(56) References Cited

U.S. PATENT DOCUMENTS 4,169,329 A * 10/1979 Atchisson ..... F41C 33/08 42/16
4,194,314 A * 3/1980 Foote ..... F41A 9/40 42/16
4,220,071 A * 9/1980 Seiderman ..... F41A 11/02 42/49.02
4,297,800 A * 11/1981 Atchisson ..... F41A 11/02 42/49.02
5,520,019 A * 5/1996 Schuetz ..... F41A 3/54 42/49.02
5,772,111 A * 6/1998 Kirsch ..... B65D 1/44 220/670
5,778,760 A * 7/1998 Yuda ..... F01B 7/00 92/128
6,070,352 A * 6/2000 Daigle ..... F41A 11/02 42/49.02
8,141,287 B2 * 3/2012 Dubois ..... F41A 21/482 42/75.01
8,387,296 B2 * 3/2013 Overstreet ..... F41A 17/36 42/50
8,479,635 B2 * 7/2013 Overstreet ..... F41A 17/36 42/70.02
8,898,946 B1 * 12/2014 Johnson ..... F41A 17/36 42/49.02
9,091,499 B2 * 7/2015 Overstreet ..... F41A 3/68
9,194,635 B1 * 11/2015 Gibbens ..... F41A 3/12
D757,884 S * 5/2016 Kielsmeier ..... D22/108
2012/0073429 A1 * 3/2012 Bowles ..... F41A 9/68 89/138
2012/0167433 A1 * 7/2012 Robbins ..... F41A 11/02 42/75.02
2014/0366417 A1 * 12/2014 Zheng ..... F41A 9/71 42/50

OTHER PUBLICATIONS

Franky Fun, "Olympic Arms AR15 9mm Glock mag adapter part 1," https://youtu.be/WEk8-8nBtxY, Published Mar. 22, 2014, Accessed Jul. 15, 2016.

Patrick Sweenty, "The Gun Digest Book of the AR-15, vol. 3," p. 159, (c) 2010, https://books.google.com/books?id=ywqWgSSn2KIC&pg=PA159&dq=magazine+well+converter+AR-15+magazine+adapter+9mm+magazine&hl=en&sa=X&ved=0ahUKEwj474ux_YTOAhWM6IMKHWpYDfsQ6AEIEg#v=onepage&q=magazine%20well%20converter%20AR-15%20magazine%20adapter%209mm%20magazine&f=false, Accessed Jul. 23, 2016.

* cited by examiner

PISTOL MAGAZINE ADAPTER

CROSS-REFERENCE TO RELATED APPLICATION

This application claims the benefit of U.S. patent application Ser. No. 15/224,691 filed on Aug. 1, 2016, entitled "PISTOL MAGAZINE ADAPTER," which claims the benefit of U.S. Provisional Patent Application No. 62/202,107 filed on Aug. 6, 2015, entitled "9 MM MAGAZINE ADAPTER," and U.S. Provisional Patent Application No. 62/233,325, filed on Sep. 26, 2015, entitled "GL MAGAZINE ADAPTER INSERT," which are hereby incorporated by reference in their entirety for all that is taught and disclosed therein.

FIELD OF THE INVENTION

The present invention relates to firearms, and more particularly to an adapter that converts an AR-15/M-16 rifle lower receiver to accept Glock® 9 mm and Glock® 40 S&W caliber pistol magazines manufactured by GLOCK, Inc. of Smyrna, Ga.

BACKGROUND OF THE INVENTION

Pistol caliber AR-15/M-16-style rifles have long been popular firearms. Pistol ammunition is considerably less expensive than rifle ammunition. In addition, recoil and report are greatly reduced with pistol ammunition compared to rifle ammunition. As a result, pistol caliber AR-15/M-16-style rifles are popular for target shooting, new shooters, and shooters of slight build.

A variety of AR-15/M-16-style rifle conversion kits exist to enable different calibers of ammunition to be fired. Many shooters who already owned Glock® pistols would like to be able to use Glock® pistol magazines in a converted AR-15/M-16-style rifle. Currently, the preferred method for accomplishing this objective is to use a dedicated lower receiver that is specially designed to accept Glock® pistol magazines. Not only is this more expensive than using a standard lower receiver, but the last round hold open mechanism is either rendered inoperable, or works inconsistently, and can require replacing the standard bolt catch spring with a weaker spring. The standard bolt also often requires modification so it will not rub on the feed lips of the magazine.

Although magazine well adapters that enable the use of Glock® magazines in a standard mil spec AR-15/M-16-style rifle lower receiver have been developed, they have not met with widespread commercial success and have either been discontinued or are not routinely available. Prior art magazine well adapters for pistol caliber magazines are prone to vibrating loose during operation and can cause marring on the inside of the lower receiver.

Therefore, a need exists for a new and improved pistol magazine adapter that enables a standard mil spec AR-15/M-16-style rifle lower receiver to use a Glock® pistol magazine. In this regard, the various embodiments of the present invention substantially fulfill at least some of these needs. In this respect, the pistol magazine adapter according to the present invention substantially departs from the conventional concepts and designs of the prior art, and in doing so provides an apparatus primarily developed for the purpose of enabling a standard mil spec AR-15/M-16-style rifle lower receiver to use a Glock® pistol magazine.

SUMMARY OF THE INVENTION

The present invention provides an improved pistol magazine adapter, and overcomes the above-mentioned disadvantages and drawbacks of the prior art. As such, the general purpose of the present invention, which will be described subsequently in greater detail, is to provide an improved pistol magazine adapter that has all the advantages of the prior art mentioned above.

To attain this, the preferred embodiment of the present invention essentially comprises a body closely received in the magazine well and defining a passage receiving a magazine including a follower, a bolt catch actuator mechanism having a follower contact element pivotally connected to the body at a pivot axis and having a follower contact surface operable to contact the follower and responsive to whether the follower is in an upper position when the magazine is empty of ammunition or a lower position in which the magazine contains ammunition, the bolt catch actuator mechanism including a latch actuator element operable to engage the bolt hold open latch, and the latch actuator element being operably engaged to the follower contact element and responsive to movement of the follower to the upper position to move the bolt hold open latch to a bolt restraint position, such that the bolt is held open after depletion of the last round in the magazine. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
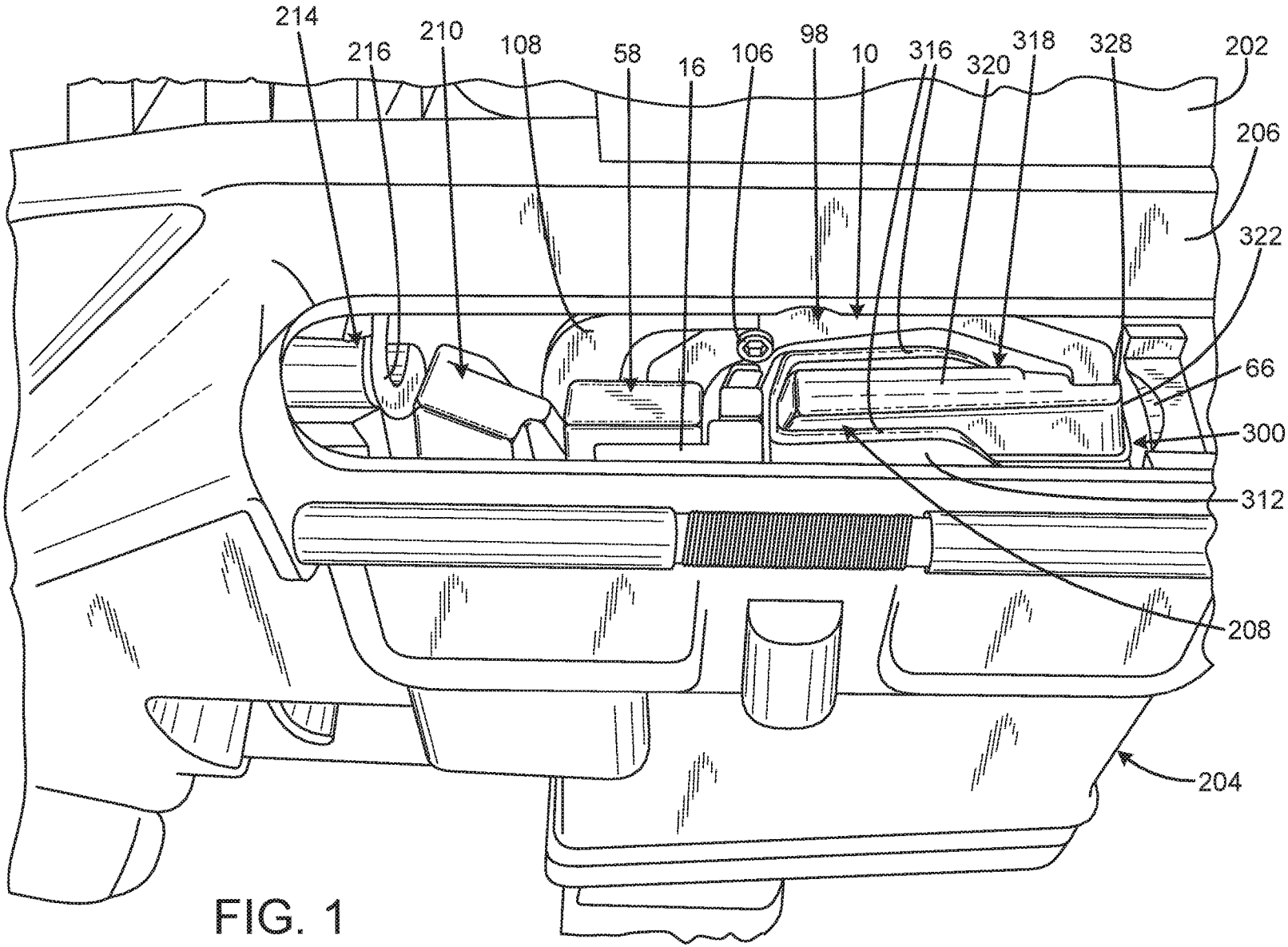
FIG. 1 is a right side view of the current embodiment of the pistol magazine adapter constructed in accordance with the principles of the present invention in use installed in a standard mil spec AR-15/M-16 style rifle lower receiver and receiving a Glock® pistol magazine.

An embodiment of the pistol magazine adapter of the present invention is shown and generally designated by the reference numeral 10.

Figure 2A:
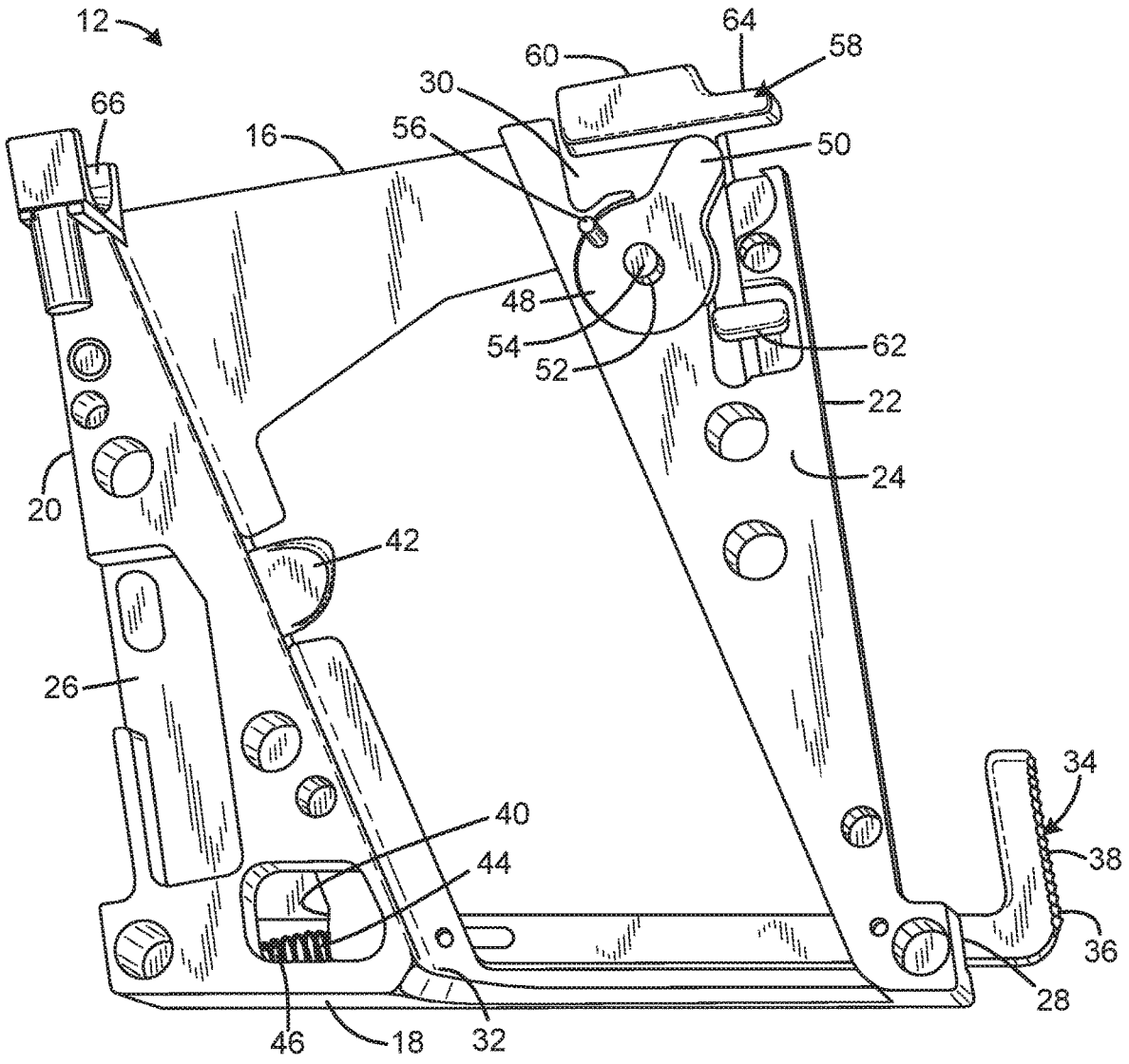
FIG. 2A is a left side view of the current embodiment of the right half of the pistol magazine adapter of FIG. 1.
Figure 2B:
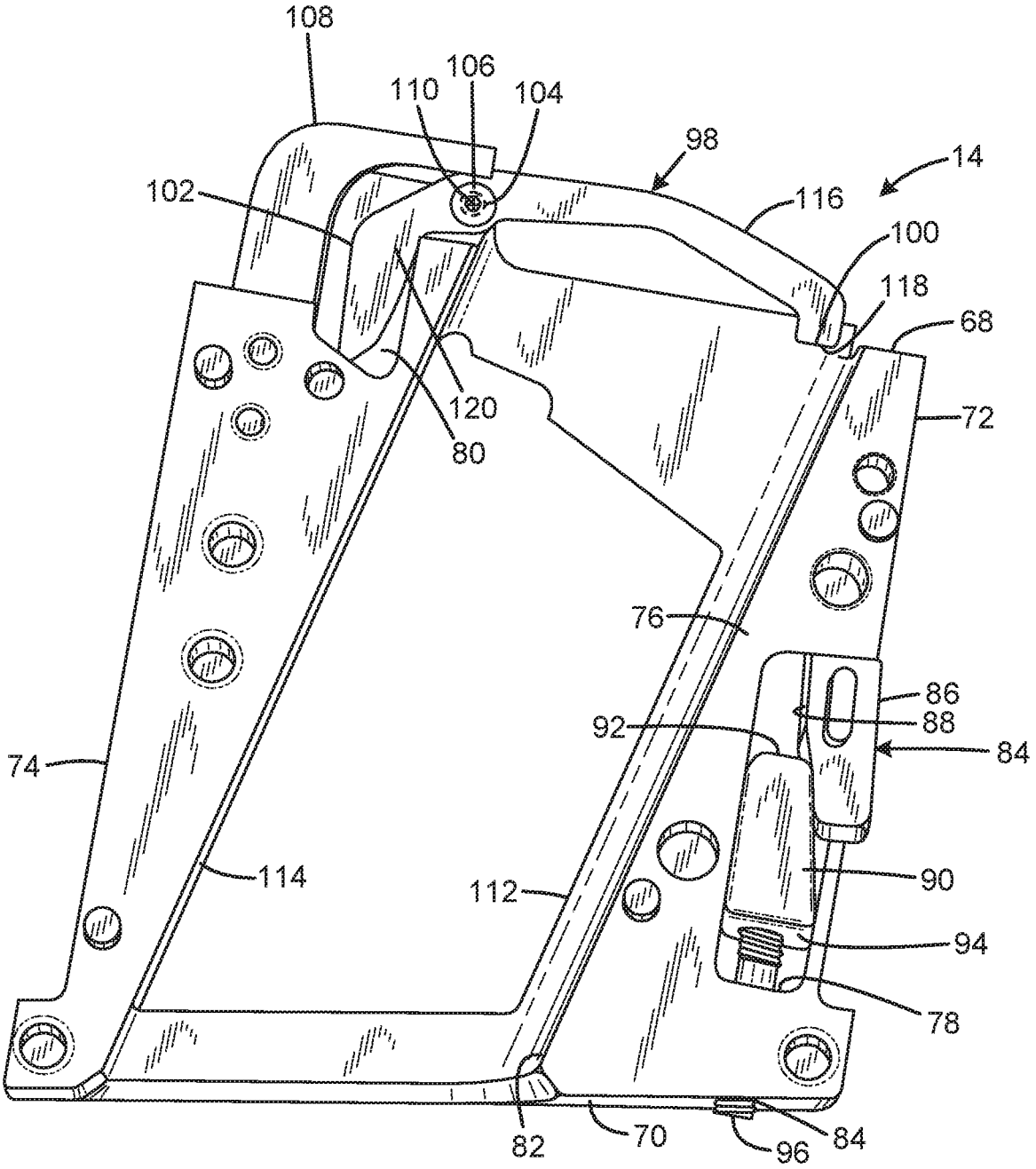
FIG. 2B is a right side view of the current embodiment of the left half of the pistol magazine adapter of FIG. 1.

FIGS. 1-2B illustrate the improved pistol magazine adapter 10 of the present invention. More particularly, in FIG. 1 the pistol magazine adapter is depicted in use installed in a firearm 200, which is a standard mil spec AR-15/M-16-style rifle in the current embodiment. The rifle has an upper receiver 202 removably connected to a lower receiver 204. The upper receiver has a right side 206 that defines an ejection port 208. A bolt 214 reciprocates within the upper receiver and is selectably restrained from moving forward by a bolt hold open latch or catch 210 after the last round has been dispensed from a magazine 300. In the current embodiment, the magazine is a Glock® 9 mm or Glock® 40 S&W caliber pistol magazine, but can be any pistol magazine sized to receive 9 mm parabellum or 40 S&W pistol cartridges. The magazine can have a fore-aft dimension greater than or equal to 1.3 inch.

The lower receiver 204 defines a magazine well 212 that receives the pistol magazine adapter 10. In the current embodiment, the magazine well is sized to receive .223 Remington, 7.62×39 or 300 blackout rifle cartridges, with a fore-aft internal opening greater than or equal to 2.398 inch. The pistol magazine adapter 10 in turn defines two halves of a magazine passage or receptacle 32, 82 that receives the top 302 of the magazine 300. The bottom 304 of the magazine protrudes below the pistol magazine adapter. A magazine latch 34 having a top latch portion 42 and a rear portion 36 forming a finger pad 38 releasably retains the magazine within the magazine receptacle. In the current embodiment, the magazine latch is a unitary part.

The pistol magazine adapter 10 has body having a right half 12 and a left half 14 that are bolted together to form the pistol magazine adapter. The right half has a top 16, bottom 18, front 20, rear 22, an interior 24, and an exterior 138. The right half defines a gib slot 26, a channel 28, a slot 30, and a magazine receptacle 32. The magazine latch 34 is slidably received within the channel. The rear 36 finger pad 38 portion protrudes rearwardly from the bottom rear of the right half. A front surface 40 of the magazine latch contacts a magazine latch spring 44 mounted against a set screw 46. The magazine latch spring biases the magazine latch rearward, which causes the top latch portion 42 of the magazine latch to releasably retain the magazine 300 within the magazine receptacle 32. A lifting cam 48 has a protruding lobe 50 and an aperture 52. The lifting cam is rotatably mounted on a dowel pin 54 and has a protruding dowel pin 56. In the current embodiment, the lifting cam has a radius of 0.233, the base of the protruding lobe where it meets the lifting cam has a radius of 0.0625, and the free end of the protruding lobe has a radius of 0.1. A bolt catch lifter 58 is slidably mounted within the slot 30. The bolt catch lifter has a top 60 and a bottom 62. The top of the bolt catch lifter defines a rear ledge 64, and the bottom of the bolt catch lifter is L-shaped. The bolt catch lifter is not attached to the right half of the pistol magazine adapter by any screws or pins and reciprocates linearly with respect to the right and left halves. The lifting cam and bolt catch lifter are positioned aft of the magazine receptacle 32. A feed ramp 66 is attached to the top front of the right half. The feed ramp guides the nose 326 of the topmost cartridge 324 (shown in FIG. 6) as the cartridge is stripped from the magazine 300 and loaded into the barrel (not shown). An ejector 108 is attached to the top rear 74 of the left half. After a loaded cartridge is discharged, the empty casing is pulled back by the extractor (not shown) on the bolt 214 against the ejector and subsequently ejected through the ejection port 208 in the upper receiver 202.

The left half 14 of the pistol magazine adapter 10 has a top 68, bottom 70, front 72, rear 74, an interior 76, and an exterior 140. The left half defines a gib slot 78, a slot 80, a magazine receptacle 82, and a tapped hole 84. The pistol magazine adapter has an anchor mechanism including a movable wedge gib adjuster 90 and a gib 84 received within the gib slot. The gib slot is significantly wider than the gib, so the gib can slide freely forward and rearward. The gib is operably connected to the gib adjuster and protrudes from the gib slot by a selected amount based on the position of the gib adjuster, such that adjustment of the gib adjuster generates outward pressure by the gib on the interior of the magazine well 212 to secure the pistol magazine adapter in the magazine well. Specifically, the gib has a front 86 and a rear 88, and the gib adjuster has a top 92 and a bottom 94. A dual action screw 96 is threadedly received within the tapped hole and has one end threadedly received within the bottom of the gib adjuster. The gib adjuster is wedge-shaped and the lower portion of the rear of the gib is also wedge-shaped relative to a plane defined by the front of the left half, resulting in a broad, angled contact region such that upward motion of the gib adjuster pushes the gib forward so the gib protrudes from the front 72 of the left half and the front 20 of the right half when the halves are assembled into the pistol magazine adapter. In the current embodiment, the dual action screw has a left-hand thread on one end and a right hand thread on the other end. This enables faster forward advancement of the gib adjuster than would be possible with a standard screw. In addition, when the dual action screw is turned counterclockwise, the gib adjuster is pulled downward away from the gib, which enables the gib to recede rearward into the gib slot. A standard screw would not pull the gib adjuster away from its wedged condition, therefore not allowing the gib to release. In the current embodiment, the gib is made of Delrin® manufactured by E. I. du Pont de Nemours and Company of Wilmington, Del., which prevents the gib from marring the front side of the magazine well 212 and absorbs vibration when the pistol magazine adapter is installed in the rifle 200. The gib also does not translate up and down, which further prevents marring. In the current embodiment, the feed ramp 66, ejector 108, bolt catch lifter 58, and gib adjuster are made of steel to maximize durability, while the remaining components of the pistol magazine adapter are made of aluminum to minimize weight.

A hold open lever 98 is pivotally attached to the top 68 of the left half 14 by a shoulder screw 106 inserted through aperture 104 that defines a pivot axis 110. The pivot axis is located aft of the magazine receptacle 32, 82 and closer to the rears 22, 74 of the right and left halves 12, 14 than to the fronts 20, 72 in the current embodiment. The hold open lever has a front 100 and a rear 102. The front of the hold open lever is a first elongated arm 116 with a free end including a follower contact surface 118. The rear 102 is received within the slot 80 in the left half and is a second arm 120 connected to the lifting cam 48. The second arm is shorter than the first arm, such that mechanical advantage is obtained. The magazine receptacle has a front wall 112 and a rear wall 114, and the follower contact surface is closer to the front wall than to the rear wall in the current embodiment. The follower contact surface is also closer to the fronts of the right and left halves than to the rears. The first and second arms are angularly offset from each other to form a bell crank. The first arm has a length of 1.30 inch relative to the center of the aperture in the current embodiment. The portion of the first arm initially extending from the pivot axis runs parallel and in line with the feed lip clearance slot (not shown) at the bottom of the bolt 214. The remainder of the first arm is bent at a 22° angle so the follower contact surface can make contact with ledge 328 on the on the follower 318 of a magazine 300. The second arm has a length of 0.40 inch relative to the center of the aperture in the current embodiment. The free end of the second arm is bent at almost a right angle to fit within slot 80.

Figure 3:
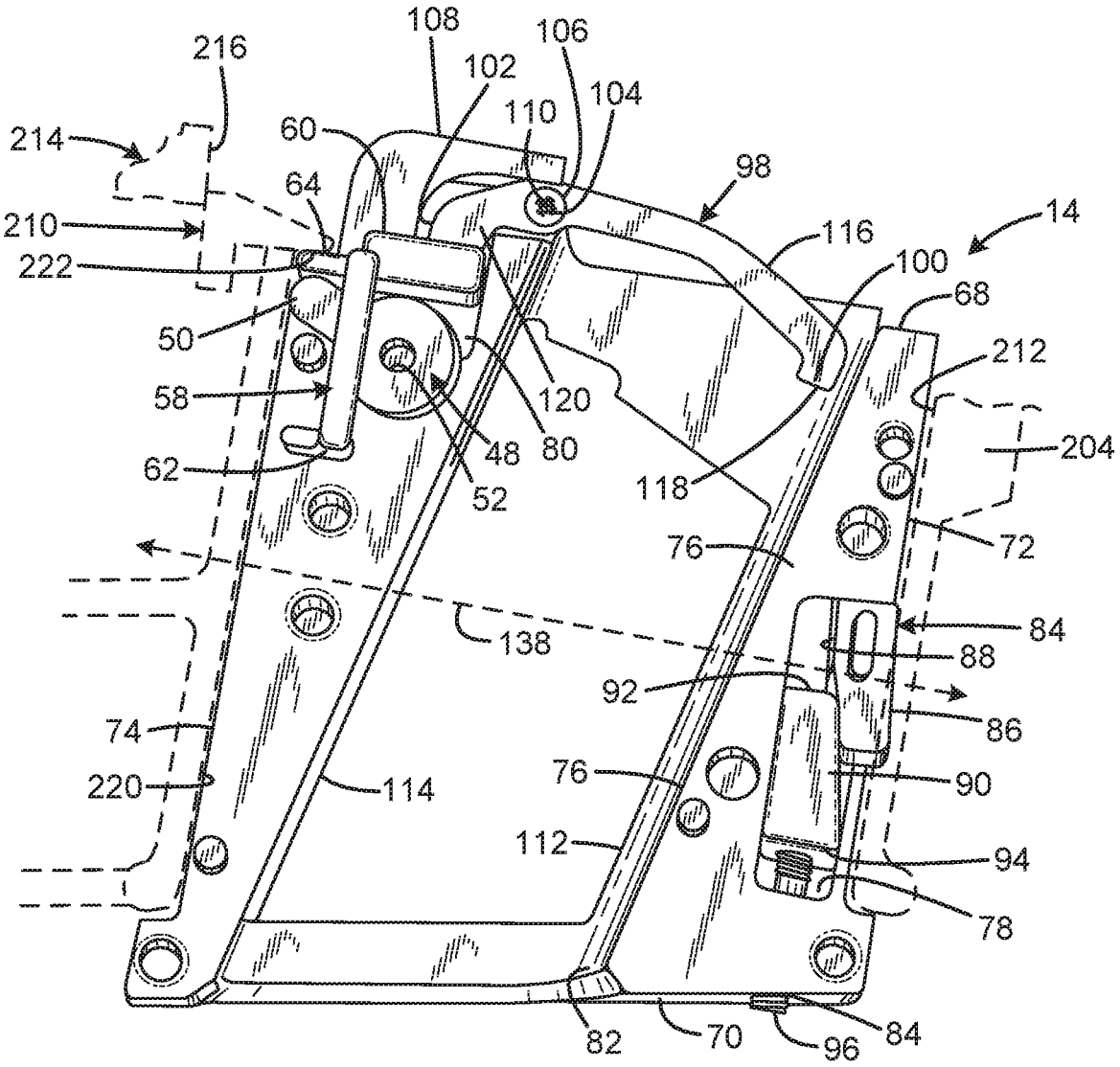
FIG. 3 is a right side view of the current embodiment of the left half of the pistol magazine adapter of FIG. 2B showing the lifting cam and bolt catch lifter in the lowered position.
Figure 4:
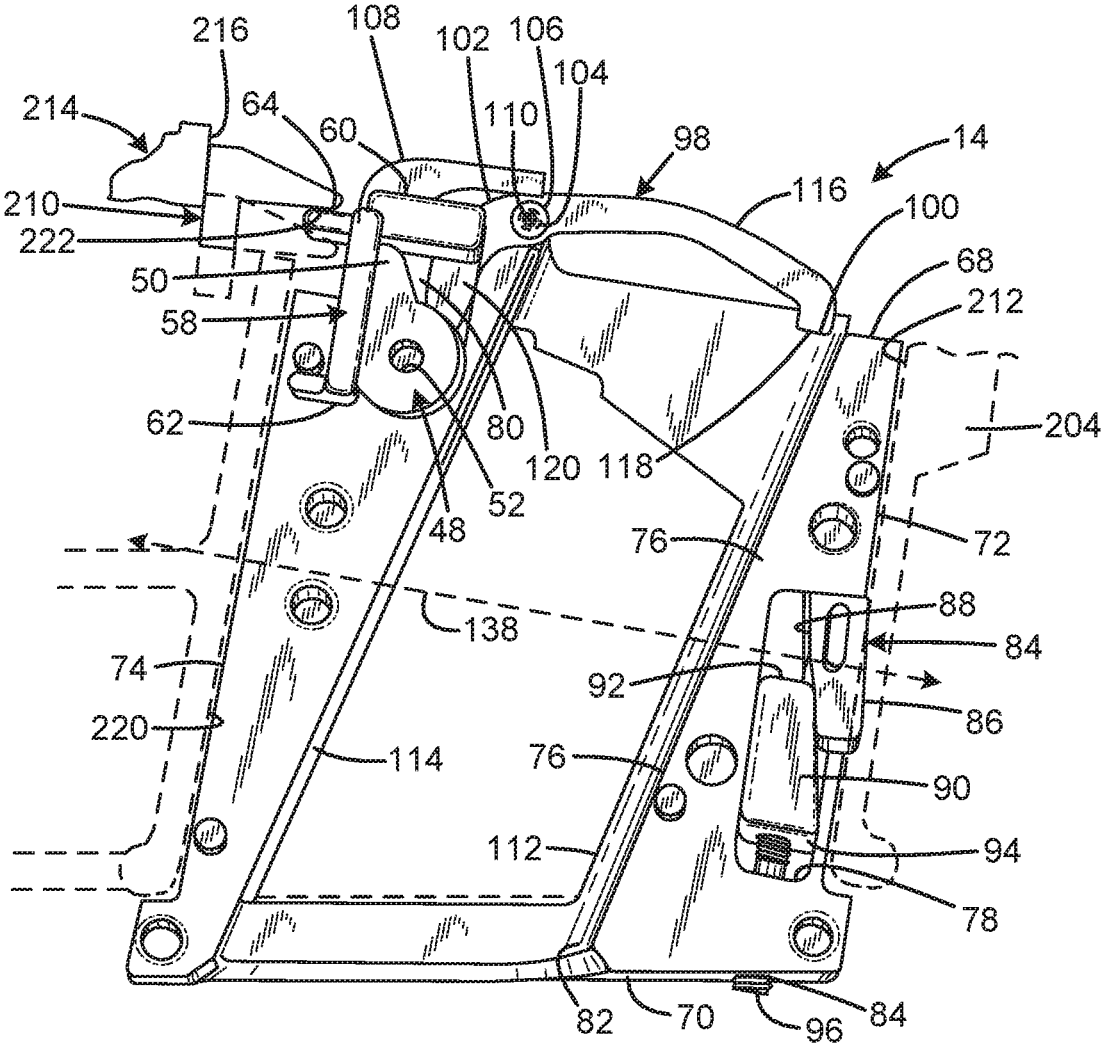
FIG. 4 is a right side view of the current embodiment of the left half of the pistol magazine adapter of FIG. 2B showing the lifting cam and bolt catch lifter in the raised position.
Figure 5:
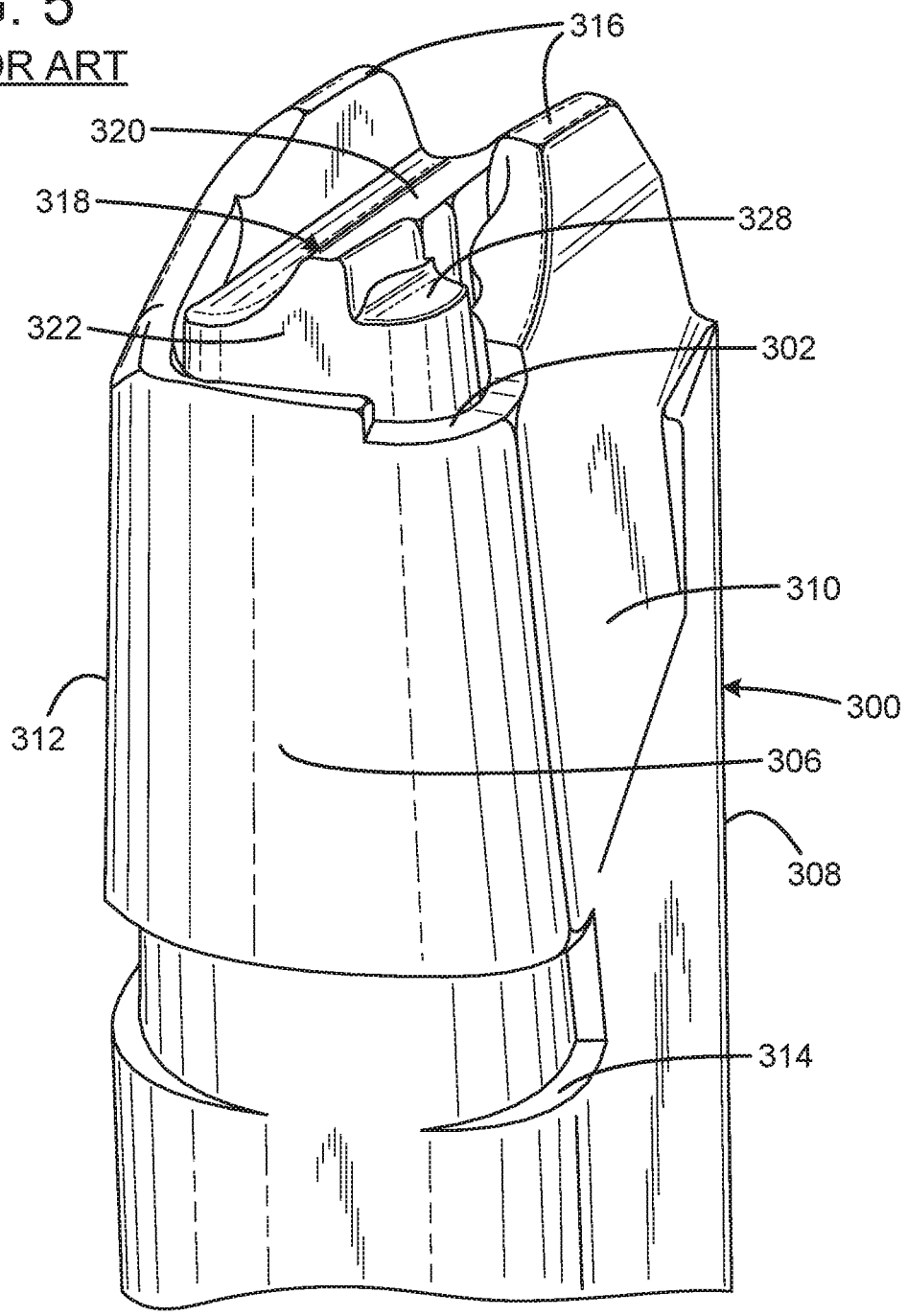
FIG. 5 PRIOR ART
FIG. 5 is a front isometric view of the Glock® pistol magazine of FIG. 1 removed from the pistol magazine adapter of the current invention.
Figure 6:
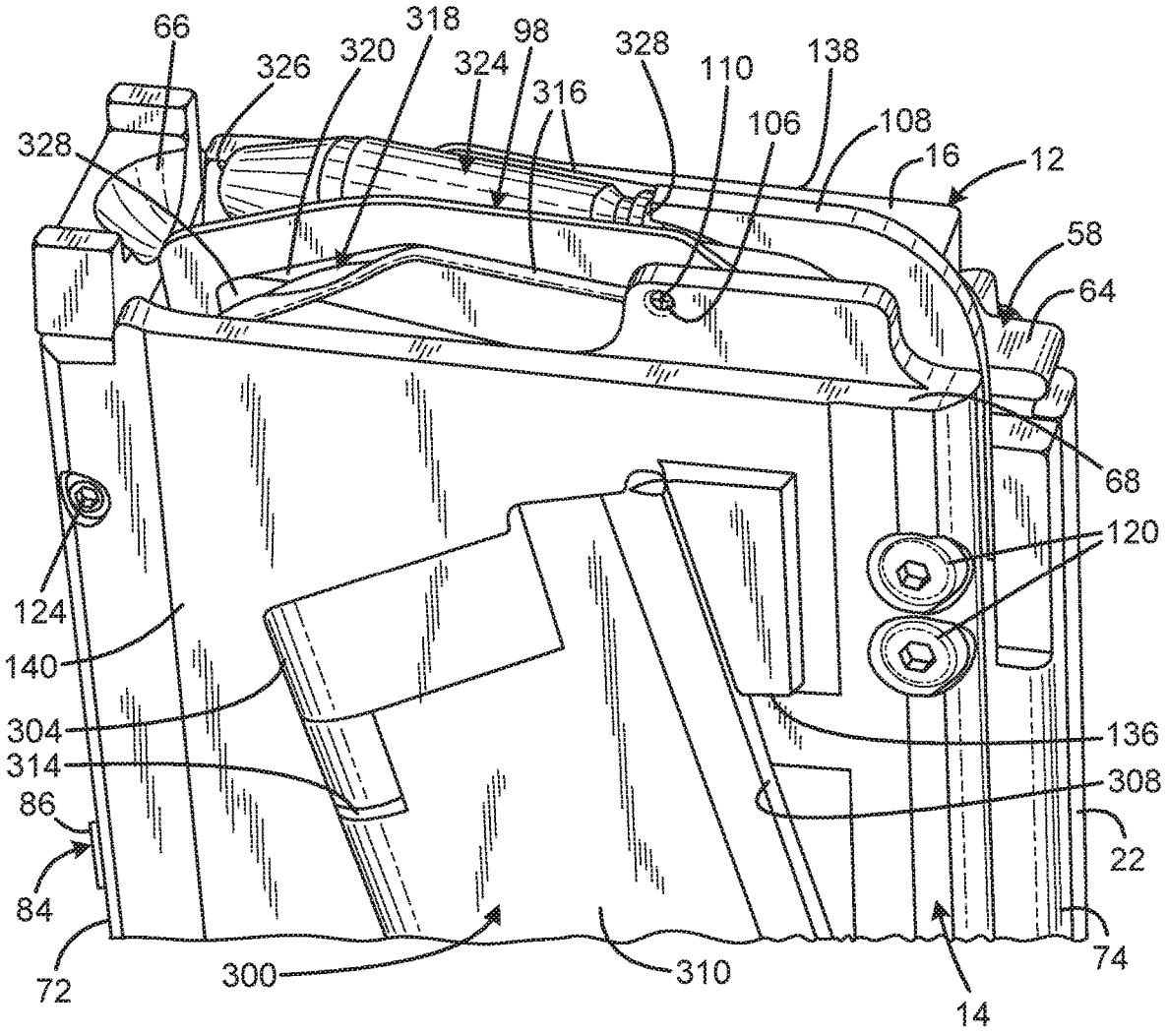
FIG. 6 is a top isometric fragmentary view of the pistol magazine adapter of FIG. 1 receiving a Glock® pistol magazine with the magazine in a loaded condition.
Figure 7:
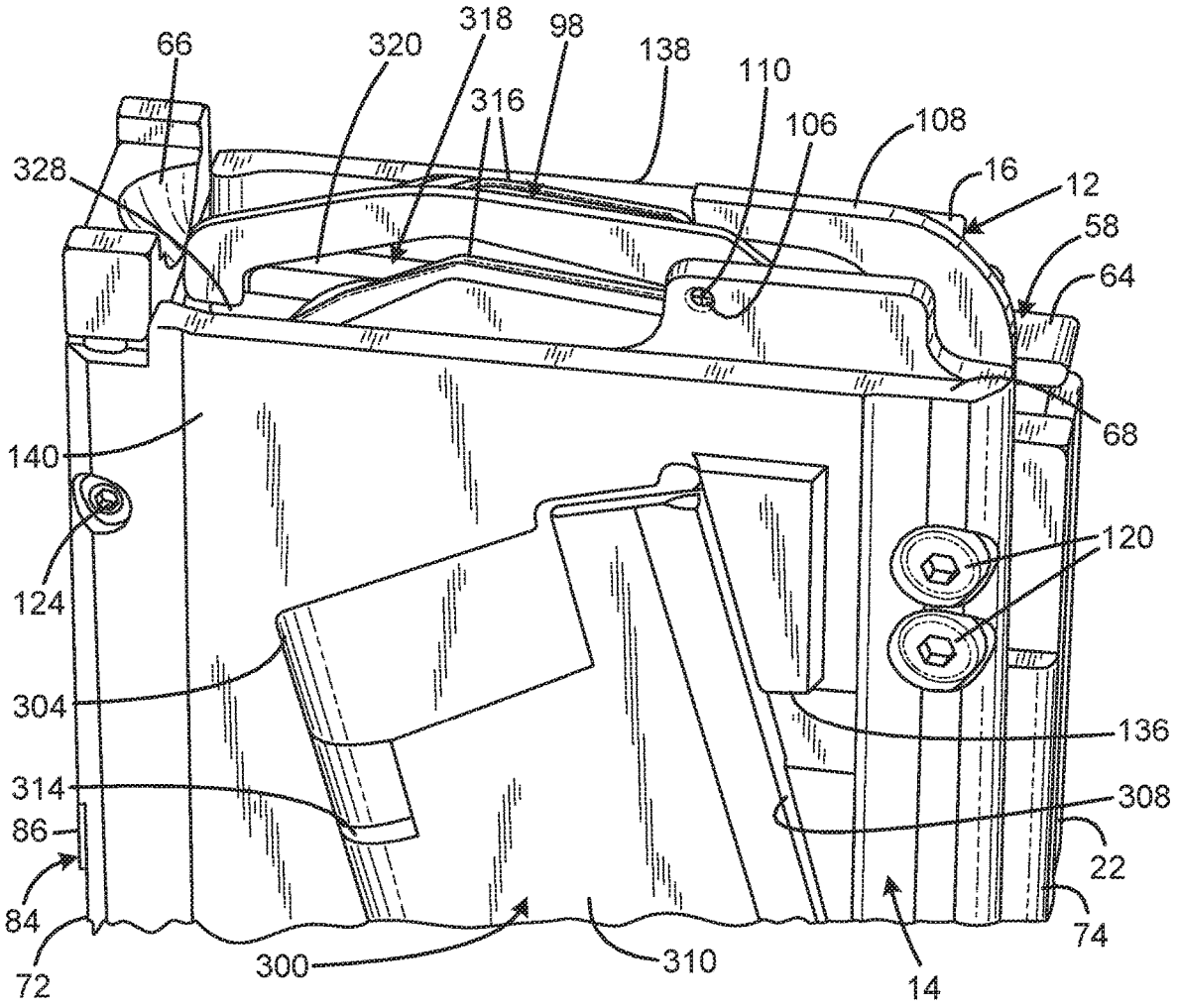
FIG. 7 is a top isometric fragmentary view of the pistol magazine adapter of FIG. 1 receiving a Glock® pistol magazine with the magazine in an empty condition.

Referring now to FIGS. 3-7, and 11, FIGS. 3 and 4 illustrate the left half 14 of the pistol magazine adapter 10, FIG. 5 illustrates a prior art Glock® pistol magazine 300, and FIGS. 6 and 7 illustrate the pistol magazine adapter with the magazine installed. More particularly, FIGS. 3 and 6 show the state of the pistol magazine adapter when at least one cartridge 324 remains in the magazine, and FIGS. 4 and 7 illustrate the state of the pistol magazine adapter after the final cartridge has been discharged from the magazine.

Figure 11:
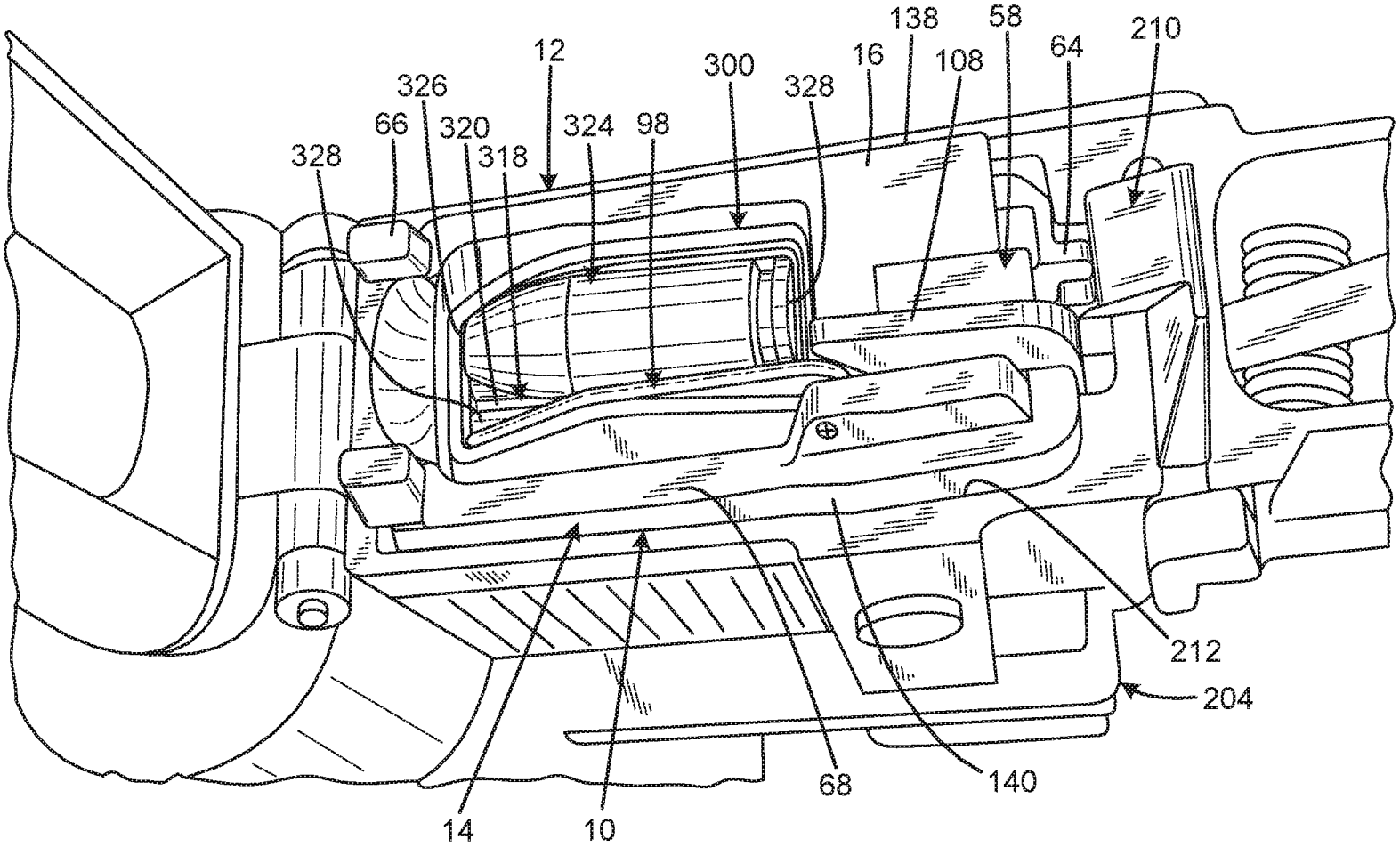
FIG. 11 is a top isometric view of the current embodiment of the pistol magazine adapter of FIG. 1 in use installed in a standard mil spec AR-15/M-16-style rifle lower receiver and receiving a Glock® pistol magazine.

In FIGS. 3, 6, and 11, the hold open lever 98 is shown with the front 100 in the lowered position, which occurs when a loaded magazine 300 is received within the magazine receptacle 82. The hold open lever, bolt catch lifter 58, and lifting cam 48 function together as a bolt catch actuator mechanism, with the bolt catch lifter serving as a latch actuator element and the hold open lever serving as a follower contact element. The bolt catch 210 within the upper receiver 202 of the rifle 200 is biased by a bolt catch spring (not shown) into a downward position. As a result, the front ledge 222 of the bolt catch pushes downward on the rear ledge 64 of the bolt catch lifter. The bolt catch lifter pushes downward on the protruding lobe 50 of the lifting cam, which causes the lifting cam 48 to rotate in a counterclockwise direction. The dowel pin 56 on the lifting cam pushes upward and rearward on the rear 102 of the hold open lever 98, which causes the hold open lever to pivot in a clockwise direction about the shoulder screw 106. As long as at least one cartridge remains in the magazine, there is nothing to obstruct the downward movement of the front of the hold open lever because the follower 318 is depressed.

In FIGS. 4 and 7, the hold open lever 98 is shown with the front 100 in the raised position, which occurs after the final cartridge has been stripped from the magazine 300 received within the magazine receptacle 82. Pivoting of the hold open lever in a first rotational direction generates rotation of the lifting cam 48 in a contrary rotational direction, which generates elevation of the bolt catch lifter 58. As is shown in FIG. 5, a magazine spring (not visible) located below the follower 318 urges the follower upwards until the follower is restrained by the feed lips 316 at the top 302 of the magazine. As the follower reaches the top of its travel range, the ledge 328 located on the front 322 top 320 of the follower contacts the follower contact surface 118 on the front of the hold open lever and raises the front of the hold open lever. As the front of the hold open lever rises, the hold open lever pivots counterclockwise about the shoulder screw 106, and the rear 102 of the hold open lever moves downward and forward within the slot 80 in the interior 76 of the left half 14. The rear of the hold open lever contacts the dowel pin 56 protruding from the lifting cam 48 and causes the lifting cam to rotate in a clockwise direction. The protruding lobe 50 in turn raises the bolt catch lifter 58. As the bolt catch lifter rises, the rear ledge of the bolt catch lifter pushes upward on the front ledge 222 of the bolt catch 210 with sufficient force to overcome the spring bias of the bolt catch. The bolt catch then rises to a sufficient height to stop forward movement of the bolt 214 by engaging a portion of the front face 216 of the bolt. This causes the bolt to hold open after the last round is discharged. Even though the magazine spring is for a pistol caliber magazine, the magazine spring is sufficiently strong to overcome the bolt catch spring because of the long lever arm provided by the front of the hold open lever. In the current embodiment, the bolt catch lifter rises 0.125 inch.

Figure 8:
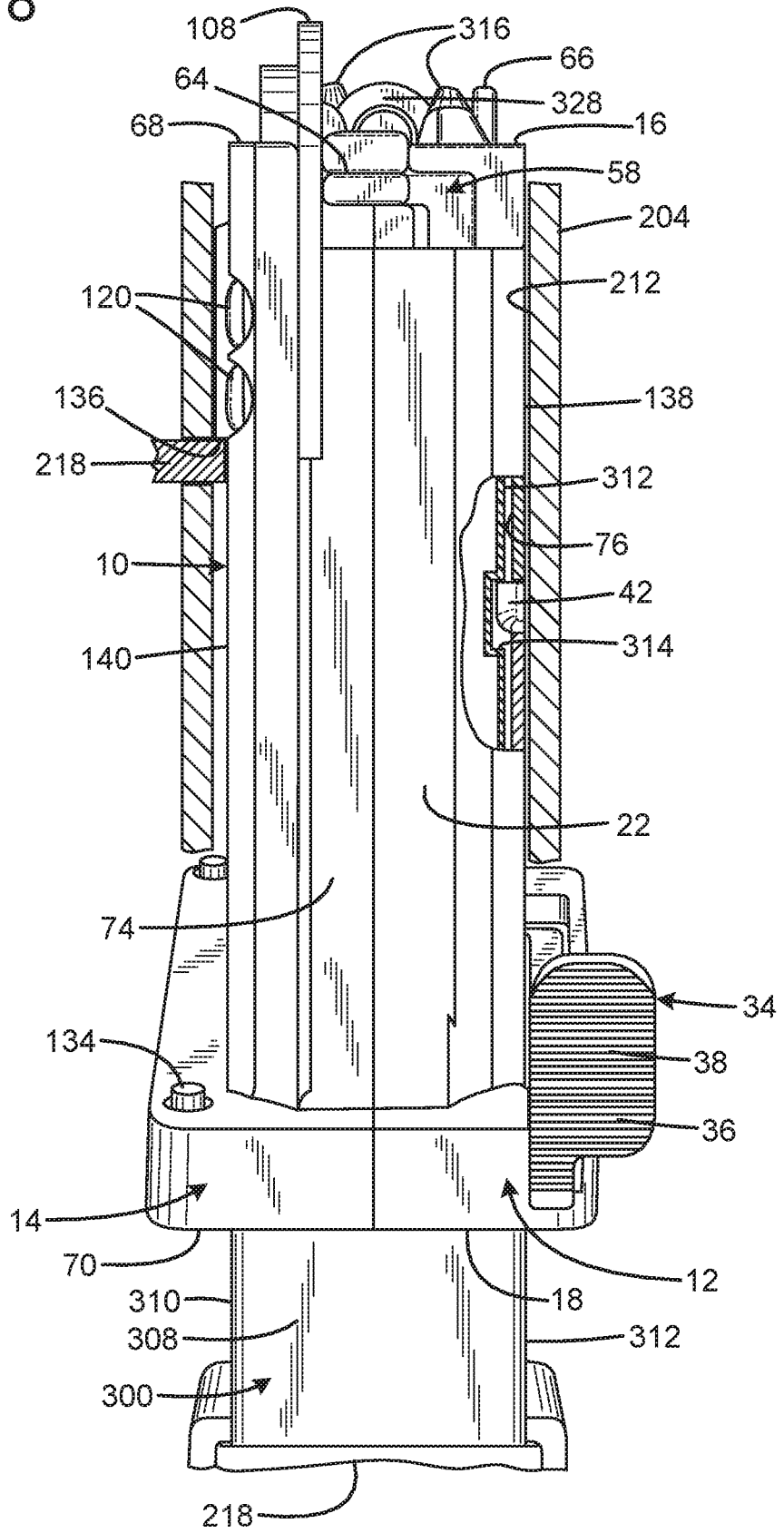
FIG. 8 is a rear view of the current embodiment of the pistol magazine adapter of FIG. 1 installed in a standard mil spec AR-15/M-16-style rifle lower receiver and receiving a Glock® pistol magazine.
Figure 9:
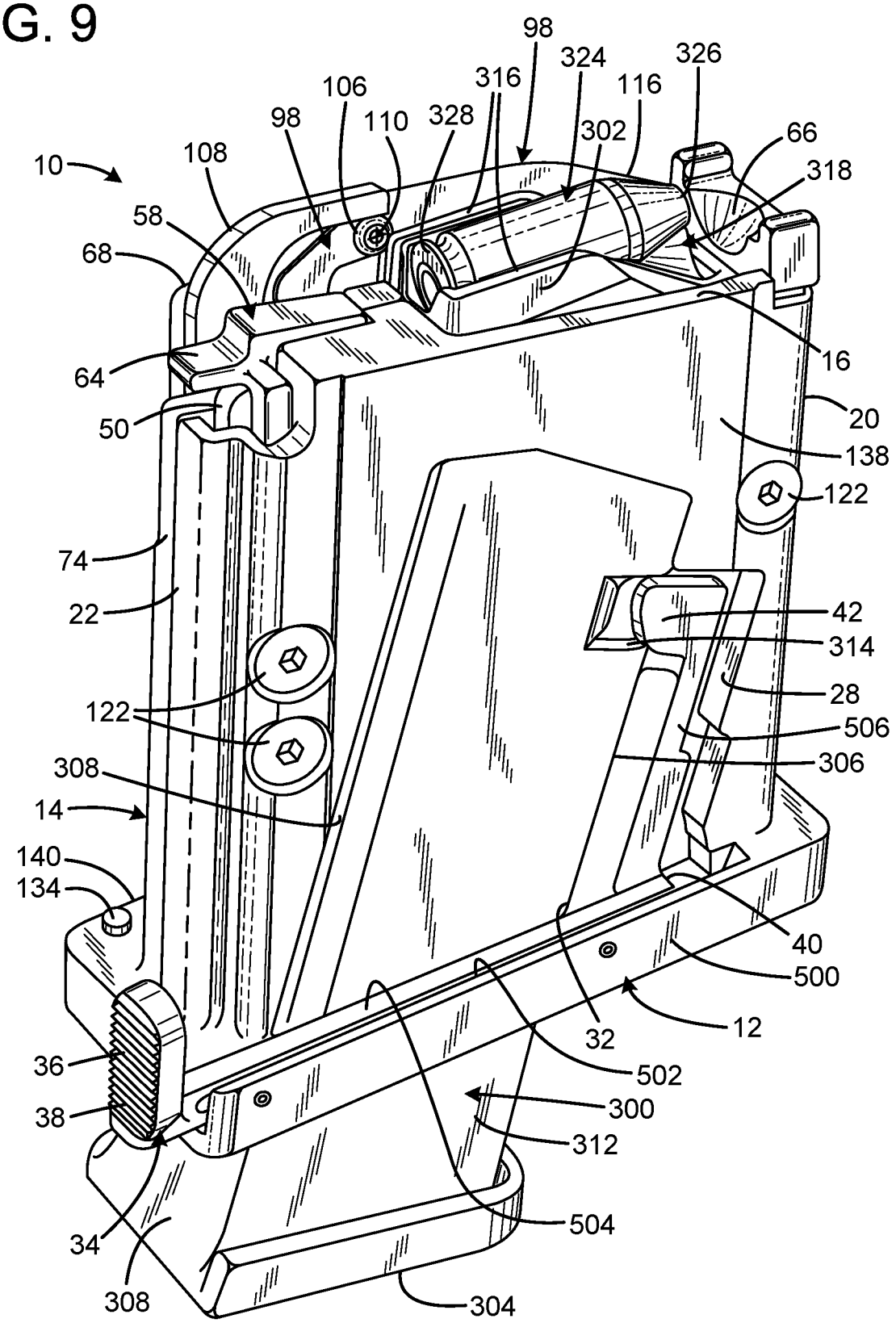
FIG. 9 is a right isometric view of the pistol magazine adapter of FIG. 6 receiving a Glock® pistol magazine with the magazine in a loaded condition with the magazine latch engaged with the magazine.
Figure 10:
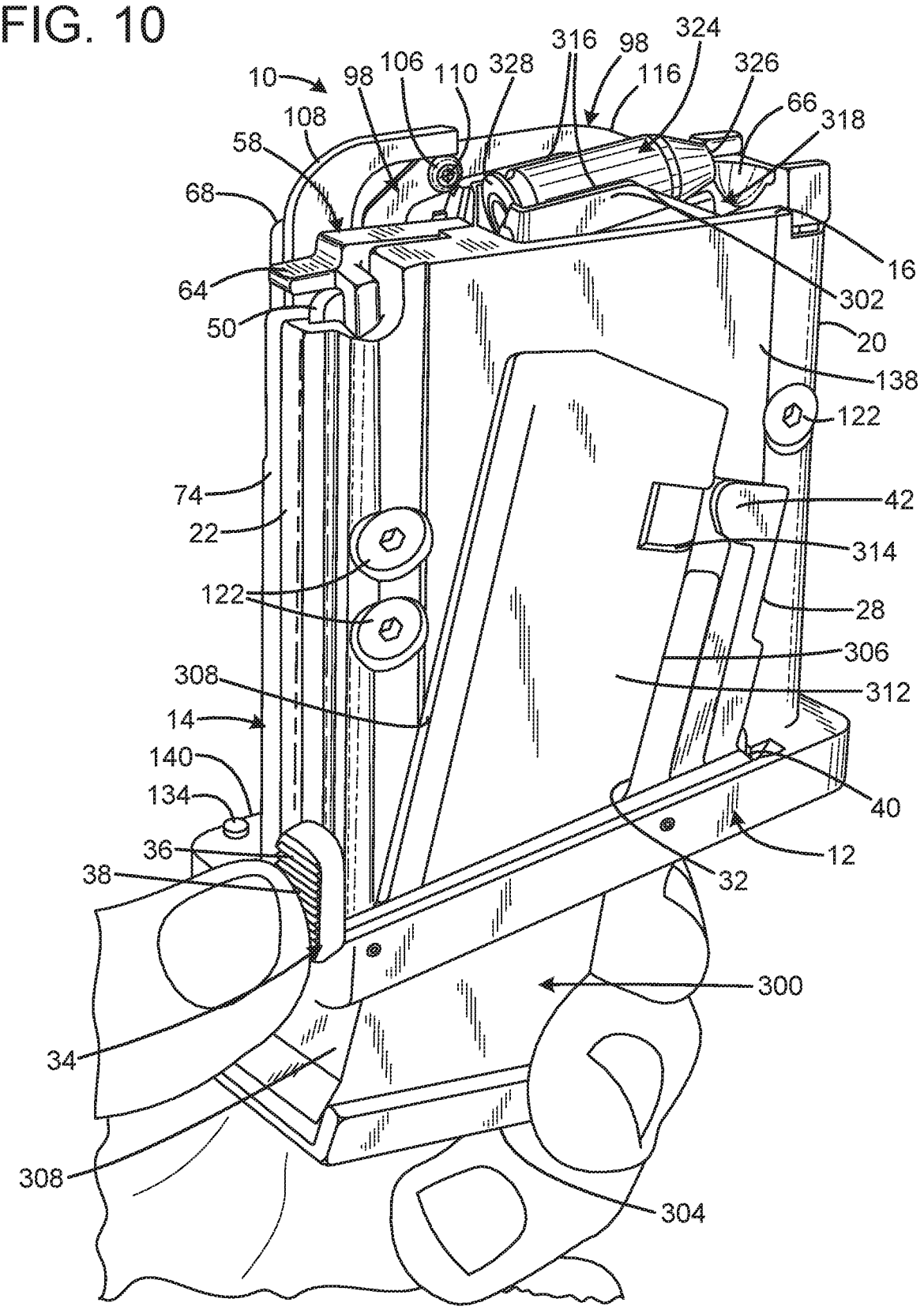
FIG. 10 is a right isometric view of the pistol magazine adapter of FIG. 6 receiving a Glock® pistol magazine with the magazine in a loaded condition with the magazine latch disengaged from the magazine.

FIGS. 8-10 illustrate the operation of the magazine latch 34 to releasably retain the top 302 of the magazine 300 within the two halves of a magazine receptacle 32, 82 defined by the right and left halves 12, 14 of the pistol magazine adapter 10. The magazine 300 includes a front pocket 314 that wraps around a portion of the left 310 and right 312 sides. In FIGS. 8 and 9, the magazine latch 34 is shown with the top latch portion 42 engaging the front pocket of the magazine. While the top latch portion is engaged with the front pocket of the magazine, the magazine cannot be withdrawn from the magazine receptacle. When the finger pad 38 of the magazine latch is pushed forward with sufficient force to overcome the magazine latch spring 44, the magazine latch slides forward on roller pins 130. This forward movement causes the top latch portion that is an upper free end of the magazine latch that extends upward from the rear portion 36 to withdraw within the channel 28 and to disengage from the front pocket of the magazine. At this point, an empty magazine can be dropped free to withdraw the magazine from the magazine receptacle. The top latch portion is shaped so that the tapered end of a full magazine can be inserted into the magazine receptacle and force the magazine latch forward while compressing the magazine latch spring 44. When the magazine is forced to its highest position, the magazine latch is forced rearward by the magazine latch spring into the open front pocket of the magazine, locking the magazine into place. The shooter can then push the bolt catch release (not shown) on the lower receiver 204 to release the bolt 214, allowing the bolt to strip the uppermost cartridge 324 from the full magazine 300 and load it into the barrel (not shown) ready to be fired. Enabling the bolt hold open system to function normally with a pistol caliber magazine enables the shooter to change magazines quickly without having to change hand positions to pull the charging handle and load the first round of the subsequent magazine into the barrel.

To clarify the above, as shown in FIG. 9 the body 14 has a lower rim portion 500 that defines an elongated lower channel portion 502 of the channel 28. An elongated lower latch member portion 504 extends in the lower channel portion 502 from the finger pad 38 to the upper member portion 506 of latch 28 topped by latch portion 42.

The top latch portion 42 is located at an intermediate position along the length of the channel 28 to releasably engage the front pocket 314 of the magazine 300 when the top 302 of the magazine is located at the proper height within the magazine receptacle 32, 82. Because the top of the magazine and the feed ramp 66 are precisely positioned at the proper height and angle by the magazine receptacle and top latch portion, the standard bolt 214 does not have to be modified to clear the feed lips to strip the cartridges 324 out of the single stack feed lips 316 of the magazine. The pistol magazine adapter 10 can be modified to accommodate a Glock® 40 S&W magazine by removing a feed ramp shim from under the feed ramp.

Also visible in FIGS. 6-8 is a rifle magazine latch ledge 136. As is shown in FIG. 8, the rifle magazine latch 218 present in the lower receiver 204 protrudes into the magazine well 212 to fit under the rifle magazine latch ledge. As a result, the rifle magazine latch works in conjunction with the gib 84 to releasably retain the pistol magazine adapter 10 within the magazine well. In addition, as is shown in FIGS. 3 and 4, the center of the gib 84 is below the center point of the front 86 of the left half 14. Since the front 86 of the gib is aligned with the rear 74 of the left half, pressure the gib creates is centered on the rear wall 220 of the magazine well.

To assemble the pistol magazine adapter 10, begin by placing the left half 14 on a flat surface with the inside surface 76 facing up. Install the hold open lever 98 by attaching the hold open lever to the left half using a 2-56×0.110 shoulder screw 106. Then, place a ⅛×⅜ dowel pin 54 in the ⅛ hole. Place the lifting cam 48 over the ⅛ dowel pin facing up, with the 1/16×11/32 dowel pin 56 that is pressed into the lifting cam, facing downward. Then, install the dual action screw 96 into the 10-32 tapped hole 84 in the bottom 70 front 86 corner of the left half. The socket head dual action screw 10-32×¾ has a left hand thread on one end and a right hand thread on the other end. Then, install the gib adjuster 90 into the left half, and subsequently install the gib 84 above and in front of the gib adjuster. Then, install the bolt catch lifter 58 in the left half. Then, install the ejector 108 by sliding it downward into a machined slot in the left half and installing two 5-40×⅜ button head screws 120. Now that all of the internal components are in place, the right 12 and left halves are held together by using three 10-32 low profile screws 122. The feed ramp 66 and a 6-32 flat point locking set screw 124 are then installed. The locking set screw locks in the feed ramp after final assembly. The magazine latch 34 is then installed into a slot 126 on the exterior 138 of the right half and is slipped into a machined channel 28 at the base of the right half then is tilted inward to nest in its machined pocket 128 on the outside of the right half. The magazine latch spring 44 and the 10-32×3/16 nylon locking set screw 46 are then installed with the set screw holding the latch spring in position. Then, install two 1/16×¼ roll pins 130 from the outside of the right half through the 1/16 wide slots 132 in the magazine latch. These roll pins allow forward and rearward motion of the magazine latch when it is pushed forward on the finger pad 38 or released and forced rearward by the magazine latch spring.

The assembled pistol magazine adapter 10 is now ready to be inserted into the magazine well 212 in the lower receiver 204 of the rifle 200. After the pistol magazine adapter is inserted into the correct position within the magazine well, the gib 84 is tightened by turning the dual action screw 96 clockwise. After the gib is tightened, the two nylon set screws 134 at the front 72 and rear 74 of the bottom 70 of the left half 14 (only the rear one is visible) are screwed in until the nylon tip touches the bottom of the lower receiver. Care must be taken not to over tighten the set screws. The magazine 300 can then be installed within the magazine receptacle 32, 82 of the pistol magazine adapter.

While a current embodiment of a pistol magazine adapter has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A magazine adapter for a firearm having a magazine well, the adapter comprising:

a body having an exterior configured to be closely received in the magazine well;

the body defining a passage configured to receive a magazine defining a magazine pocket;

a magazine latch movable with respect to the body between an engaged position and a disengaged position;

the magazine latch having a top latch portion configured to be received in the magazine pocket when the magazine latch is in the engaged position to prevent extraction of the magazine from the passage, and to be clear of the magazine pocket when the magazine latch is in the disengaged position to enable extraction of the magazine from the passage; and wherein the magazine adapter body has a lower rim portion in part defining a lower channel portion of the passage, and wherein the magazine latch has an elongated lower latch member portion that extends along and parallel to the lower rim portion.

2. The magazine adapter of claim 1 wherein the elongated lower latch member portion extends from a rear portion of the body to a position forward of the passage.

3. The magazine adapter of claim 2 wherein the magazine latch has an upper member latch portion extending upward from the elongated lower latch member portion.

4. The magazine adapter of claim 3 wherein the upper member latch portions has an engagement surface perpendicular to the length of the upper member latch portion.

5. The magazine adapter of claim 3 wherein the upper member latch portion has an engagement surface angularly disposed with respect to the length of the upper member latch portion, such that advancement of the magazine latch along a path causes the engagement surface to move the magazine along its length.

6. The magazine adapter of claim 2 wherein the elongated lower latch member portion is lateral to the passage.

7. The magazine adapter of claim 2 including a finger pad adapted for manual actuation of the magazine latch and positioned at a rear end of the elongated lower latch member portion.

8. The magazine adapter of claim 2 wherein the elongated lower latch member portion extends parallel to the lower channel portion.

9. The magazine adapter of claim 2 wherein the elongated lower latch member portion is movable in a direction along the length of the elongated lower latch member portion.

10. The magazine adapter of claim 2 wherein the magazine latch has an engagement surface angularly disposed with respect to the elongated lower latch member portion.

11. The magazine adapter of claim 1 including a spring biasing the magazine latch to the engaged position.

12. The magazine adapter of claim 1 wherein the top latch portion is positioned at an intermediate position along the length of the passage.

13. The magazine adapter of claim 1 wherein the magazine latch is movable in a fore-aft direction.

14. A magazine adapter for a firearm having a magazine well, the adapter comprising: a body having an exterior configured to be closely received in the magazine well; the body defining a passage configured to receive a magazine defining a pocket; a magazine latch movable with respect to the body between an engaged position and a disengaged position; the magazine latch having a top latch portion configured to be received in the magazine pocket when the magazine latch is in the engaged position to prevent extraction of the magazine from the passage, and to be clear of the magazine pocket when the magazine latch is in the disengaged position to enable extraction of the magazine from the passage; and wherein the top latch portion is positioned at an intermediate position along the length of the passage.

15. The magazine adapter of claim 14 including a spring biasing the magazine latch to the engaged position.

16. The magazine adapter of claim 14 wherein the magazine latch is movable in a fore-aft direction.

* * * * *